United States Patent [19]

Hanna et al.

[11] 4,066,167

[45] Jan. 3, 1978

[54] RECLOSEABLE PACKAGE

[75] Inventors: Ward T. Hanna, Palatine, Ill.; John J. Drennan, Cincinnati, Ohio; John T. Staroska, La Grange, Ill.

[73] Assignee: Keebler Company, Elmhurst, Ill.

[21] Appl. No.: 703,614

[22] Filed: July 8, 1976

[51] Int. Cl.[2] ..... B65D 33/18

[52] U.S. Cl. ..... 206/627; 206/629; 229/62

[58] Field of Search ..... 229/66, 62, 80

[56] References Cited

U.S. PATENT DOCUMENTS

| | | | |
|---|---|---|---|
| 2,117,738 | 5/1938 | Metzger | 229/66 X |
| 3,038,651 | 6/1962 | Cloudsley | 229/66 X |
| 3,212,698 | 10/1965 | Balcom | 229/62 |
| 3,301,466 | 1/1967 | Perino et al. | 229/62 |
| 3,412,926 | 11/1968 | Bostwick | 229/66 X |
| 3,545,668 | 12/1970 | Hultberg | 229/66 X |
| 3,565,738 | 2/1971 | Kirkpatrick | 229/66 X |
| 3,806,024 | 4/1974 | Marchesani | 229/62 |

FOREIGN PATENT DOCUMENTS

| | | | |
|---|---|---|---|
| 449,402 | 4/1968 | Switzerland | 229/62 |

*Primary Examiner*—Stephen P. Garbe

*Attorney, Agent, or Firm*—Allegretti, Newitt, Witcoff & McAndrews

[57] ABSTRACT

A recloseable package, having a bag portion, closing portion and seal portion, is disclosed. The seal portion seals the recloseable package, after filling, in a conventional fashion. The recloseable package is opened by separation of the seal portion. The recloseable package is thereafter closed by the closing portion and an adhesively attachable strip.

5 Claims, 3 Drawing Figures

RECLOSEABLE PACKAGE

BACKGROUND OF THE INVENTION

The present invention relates to a recloseable package or bag. Various types of recloseable packages are known, as illustrated by U.S. Pat. Nos. 2,153,310, 3,212,698, 3,301,466, and 3,565,738.

In each case, the recloseable seal is utilized to seal the package after filling. That is, the package is not sealed in a conventional fashion, despite the preservation advantages derived therefrom. Consequently, with foods, such as cookies, the package contents more quickly stale before the initial opening of the package by the consumer, due to the decreased effectiveness of the recloseable seal over a conventional seal.

A more effective recloseable seal can be provided by extensive folding of the package end. This, however, significantly complicates a packaging process and increases packaging cost.

SUMMARY OF THE INVENTION

In a principal aspect, the present invention, a recloseable package, includes a bag portion, closing portion and seal portion. The seal portion is detachably joined to the closing portion and seals the recloseable package after filling. The recloseable package is initially opened by removal or separation of the seal portion from the closing portion. Once opened, the package is closed by the closing portion and an adhesively attachable strip.

The closing portion has a fold line which defines a tapering section and flap section. The flap section is foldable upon the tapered section to close the recloseable package. The adhesively attachable strip maintains the closure.

It is thus an object of the present invention to provide a recloseable package or bag. It is also an object to provide a recloseable package which is sealed, after filling, in a conventional manner.

Another object of the present invention is to provide a recloseable package which is readily opened by removal of a conventional seal portion. A specific object of the present invention is to provide a conventionally sealed package having a closing portion to reclose the package after initial opening. It is yet another object of the present invention to provide an inexpensively and readily manufactured recloseable package.

These and other objects, features and advantages of the present invention are apparent in the following detailed description.

BRIEF DESCRIPTION OF THE DRAWING

A preferred embodiment of the present invention will be described, in detail, with respect to the drawing wherein.

DESCRIPTION OF THE PREFERRED EMBODIMENT

Figure 1:
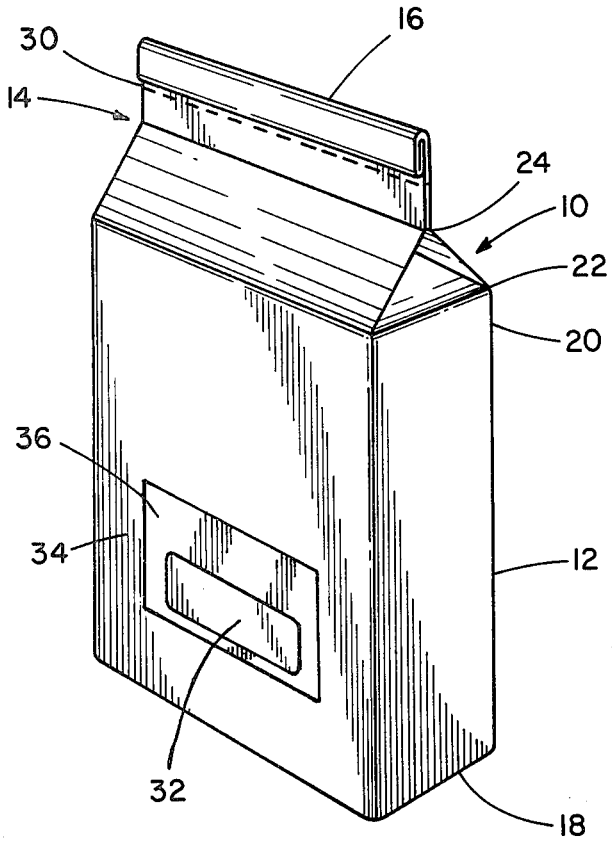
FIG. 1 illustrates a preferred embodiment of the present invention in a sealed state.
Figure 2:
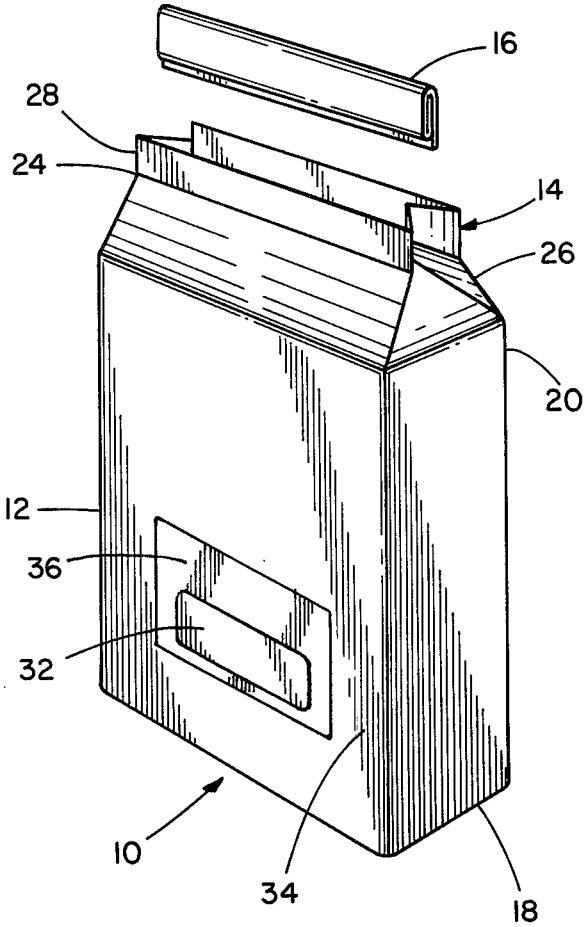
FIG. 2 illustrates the preferred embodiment of FIG. 1 in an open state.
Figure 3:
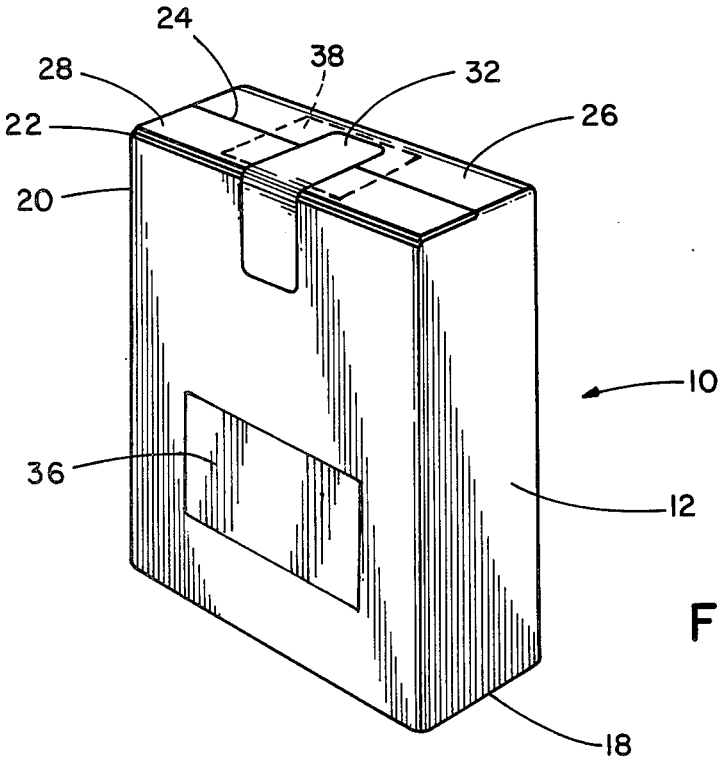
FIG. 3 illustrates the preferred embodiment of FIG. 1 in a closed state.

Referring to FIGS. 1–3, a preferred embodiment of the present invention is shown as a recloseable package 10. The recloseable package 10 is illustrated in a sealed, open and closed state in FIGS. 1, 2 and 3, respectively.

As shown, the recloseable package 10 includes a bag portion 12, a closing portion 14 and a seal portion 16. The bag portion 12 has a closed end 18 and an open end 20. The closing portion 14 joins the bag portion 12 at the open end 20 to define a first junction 22.

The closing portion 14 has folded-in sides and a fold line 24 to define a tapered section 26 and flap section 28. As shown, the tapered section 26 of the closing portion 14 is adjacent the bag portion 12.

The seal portion 16 detachably joins the flap section 28 of the closing portion 14 at a second junction 30. The seal portion 16 seals the recloseable package 10 after filling.

Preferably, the seal portion 16 is folded and adhesively maintained in a rolled configuration. The second junction 30 is preferably perforated, as shown in FIG. 1, to facilitate the initial opening of the recloseable package 10 by removal and separation of the seal portion 16.

Once opened by removal of the seal portion 16, the recloseable package 10 is closeable by the closing section 14. As best shown in FIG. 3, the flap section 28 of the closing portion 14 folds upon the tapered section 26 to close the recloseable package 10. In this preferred embodiment, the edge of the flap section 28 substantially aligns with a portion of the first junction 22 in the closed state.

The recloseable package 10 further includes an adhesively attachable strip 32 to maintain the closing portion 14 in the closed state. The adhesively attached strip 32 has a non-drying adhesive on one side thereof.

In the closed state, the adhesively attachable strip 32 is attached over the closing portion 14 to secure the flap section 28 against the tapered section 26. That is, the adhesively attachable strip 32 attaches to the bag portion 12 and flap section 28 over the first junction 22. The adhesively attachable strip 32 is otherwise preferably attached to a lower section 34 of a bag portion 12.

The bag portion 12 and closing portion 14 include protective strips 36 and 38 to facilitate removal of the adhesively attachable strip 32. For clarity, the closing portion strip 38 is shown in phantom only in FIG. 3. Preferably cellophane, the protective strips 36 and 38 substantially avoid adhesion of package fibers to the adhesively attachable strip 32 to increase the life thereof.

Sealing of the recloseable package 10 by the seal portion 16 after filling enhances the preservation capability of the recloseable package 10 over the presently known packages of this type. Preferably, the flap section 28 of the closing portion 14 is also tackily sealed by an adhesive in the sealed state to form a sealed flap area which will further improve the preservation capability. Once opened, the recloseable package 10 is conveniently and readily closed by the closing portion 14 and adhesively attachable strip 32.

A single preferred embodiment of the present invention has been described herein. It is to be understood, however, that various modifications and changes can be made without departing from the true scope and spirit of the present invention as defined in the following claims.

What is claimed is:

1. A recloseable package having a sealed state, an open state and a closed state, said reclosable package comprising, in said sealed state:

a bag portion having a closed end and an open end;

a closing portion joined to said bag portion at said open end, said closing portion including a tapered section adjacent said bag portion and a flap section, said flap section being tackily sealed in said sealed state to define a sealed flap area;

a seal portion joined to said flap section;

a perforation between said seal portion and said closing portion to facilitate separation and removal of said seal portion, said sealed flap area being between said tapered section and said perforation;

an adhesive strip attached to said reclosable package in an inoperative position;

said reclosable package being operable in said open state whenever said seal portion is separated from said flap section and discarded and said sealed flap area is opened;

said flap section being foldable upon said tapered section in said open state to define a folded position;

said reclosable package being operable in said closed state whenever said flap section is placed in said folded position, said adhesive strip is removed from said inoperative position, and said adhesive strip is attached to said reclosable package in an operative position to maintain said flap section in said folded position.

2. A recloseable package as claimed in claim 1 wherein said adhesively attachable strip is attached to said bag portion in said sealed state.

3. A recloseable package as claimed in claim 1 wherein said adhesively attached strip is attached to said bag portion and said closing portion in said closed state.

4. A recloseable package as claimed in claim 1 wherein said closing portion and said bag portion include a protective strip to facilitate removal of said adhesively attachable strip.

5. A recloseable package as claimed in claim 4 wherein said protective strip is cellophane.

* * * * *